US006021654A

United States Patent [19]

McCaa

[11] Patent Number: 6,021,654

[45] Date of Patent: *Feb. 8, 2000

[54] DOOR LOCK WITH CLUTCH ARRANGEMENT

[75] Inventor: Eugene S. McCaa, Vista, Calif.

[73] Assignee: NT Falcon Lock, Brea, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/976,077

[22] Filed: Nov. 21, 1997

Related U.S. Application Data

[62] Division of application No. 08/374,415, Jan. 19, 1995.

[51] Int. Cl.[7] ..... E05B 55/06

[52] U.S. Cl. ..... 70/149; 70/223; 70/472; 292/336.3

[58] Field of Search ..... 70/149, 145, 218, 70/221–224, 467, 468, 471–473, 476, 477, 481, 482; 292/336.3, 357, 359, DIG. 30, 37

[56] References Cited

U.S. PATENT DOCUMENTS

| | | | |
|---|---|---|---|
| 1,834,223 | 12/1931 | Rymer . | |
| 1,842,182 | 1/1932 | Lindsay | 70/222 |
| 2,062,598 | 12/1936 | Nelson | 70/91 |
| 2,175,791 | 10/1939 | Brauning | 70/146 |
| 2,197,508 | 4/1940 | Peo | 292/352 |
| 2,497,328 | 2/1950 | Smith et al. | 70/223 X |
| 2,634,598 | 4/1953 | Kaiser | 70/146 |
| 2,672,041 | 3/1954 | Heyer | 70/223 |
| 3,105,712 | 10/1963 | Duvall | 70/476 X |
| 3,718,015 | 2/1973 | Tornoe et al. | 70/224 |
| 3,856,339 | 12/1974 | Tornoe et al. | 292/336.3 |
| 3,896,644 | 7/1975 | Nagy et al. | 70/149 |
| 3,922,896 | 12/1975 | Kagoura | 70/223 |
| 3,955,387 | 5/1976 | Best et al. | 70/224 |
| 4,108,482 | 8/1978 | Dietrich et al. | 292/165 |
| 4,201,069 | 5/1980 | Katayama et al. | 70/224 |
| 4,333,324 | 6/1982 | Dietrich et al. | 70/107 |
| 4,429,556 | 2/1984 | Kambic | 70/149 |
| 4,437,695 | 3/1984 | Foshee | 292/352 |
| 4,631,944 | 12/1986 | Gater et al. | 70/223 X |
| 4,648,639 | 3/1987 | Martin et al. | 70/472 X |
| 4,655,059 | 4/1987 | Best et al. | 70/224 |
| 4,660,395 | 4/1987 | Huang et al. | 70/223 X |
| 4,672,829 | 6/1987 | Gater et al. | 70/472 |
| 4,869,083 | 9/1989 | DeMarseilles et al. | 70/224 |
| 4,920,773 | 5/1990 | Surko, Jr. | 70/224 |
| 5,010,752 | 4/1991 | Lin | 70/472 X |
| 5,149,155 | 9/1992 | Caseti et al. | 292/336.3 |
| 5,372,025 | 12/1994 | Lin | 70/223 X |
| 5,481,890 | 1/1996 | Millman | 70/224 |

*Primary Examiner*—Suzanne Dino Barrett
*Attorney, Agent, or Firm*—Don Finkelstein

[57] ABSTRACT

A driver element in this lock has two outer surface sections. The first of the sections has a first geometrical cross-sectional configuration which engages an outer lever spindle in both the locked and unlocked condition. In the unlocked condition the first section also engages an outer driver spindle which rotates with the outer lever handle and outer lever spindle and engages the latch retraction structure for retraction of the latch. In the locked position, a push button on the inner handle pushes the driver such that a second section of the outer surface of the driver is aligned with the outer drive spindle and the second section is free of driving engagement with the outer driver spindle such that operation of the latch is prevented when the outer lever handle is rotated.

16 Claims, 8 Drawing Sheets

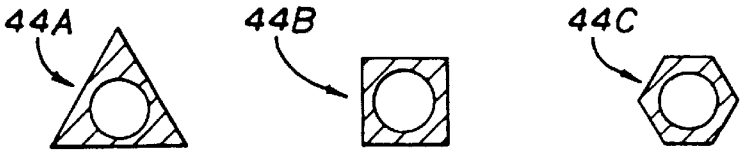
FIG. 8A
FIG. 8B
FIG. 8C
FIG. 8D
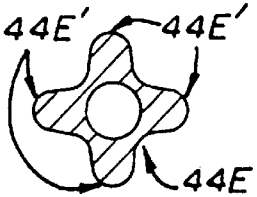
FIG. 8E
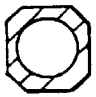
FIG. 8F
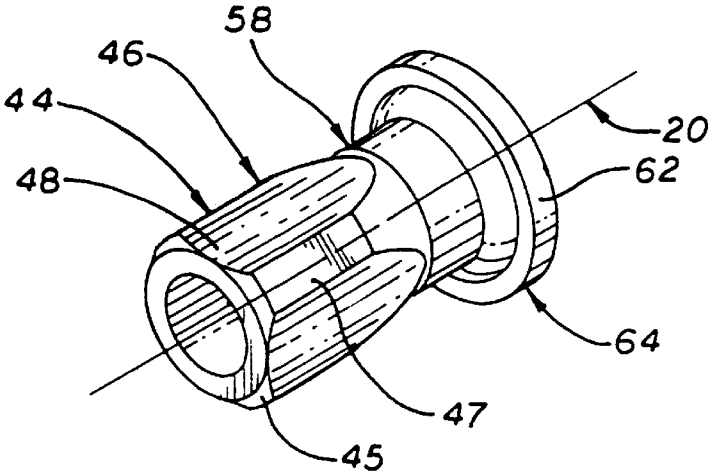
FIG. 7
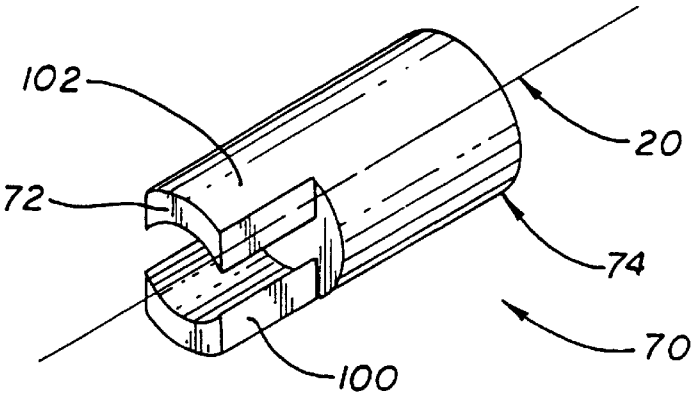
FIG. 11

DOOR LOCK WITH CLUTCH ARRANGEMENT

This application is a Division of pending patent application Ser. No. 08/374,415, filed Jan. 19, 1995.

BACKGROUND OF THE INVENTION

1. Field of the Invention

This invention relates to a lock arrangement in which a declutching mechanism is provided so that in the locked position rotation of the outer handle does not cause actuation and retraction of the latch.

2. Description of the Prior Art

In many of the prior art lock devices, there is incorporated a clutch mechanism by which the latch may be disengaged by manipulation of the inner handle so that the outer handle may be free to rotate when the clutch is disengaged without retraction of the latch. Such arrangements have not, in many instances, proven to be sufficiently strong enough in their operation to withstand comparatively heavy rotational forces on the outer handle. In particular, when the outer handle is a lever as now often required under various state and federal laws in the United States for handicapped access, the forces can be considerable depending upon the length of the lever.

Examples of such declutching mechanisms are shown, for example, in U.S. Pat. No. 4,920,773 in which a declutching mechanism is utilized in connection with a lever handle lock.

Other examples of the prior art patents are shown in, for example, U.S. Pat. No. 2,634,598. Additionally, other examples of prior art lock arrangements are shown in:

| Inventor | Patent No. | Issue Date |
|---|---|---|
| J. A. Rymer | 1,834,223 | 12/01/31 |
| W. F. Nelson | 2,062,598 | 12/01/36 |
| K. A. Brauning | 2,175,791 | 10/10/39 |
| R. F. Peo | 2,197,508 | 04/16/40 |
| F. K. Heyer | 2,672,041 | 03/16/54 |
| Tornoe et al. | 3,718,015 | 02/27/73 |
| Tornoe et al. | 3,856,339 | 12/24/74 |
| Tranberg et al. | 3,881,331 | 05/96/75 |
| Nagy et al. | 3,896,644 | 07/29/75 |
| Kagoura | 3,922,896 | 12/02/75 |
| Dietrich et al. | 4,108,482 | 08/22/78 |
| Dietrich et al. | 4,333,324 | 06/08/82 |
| Kambic | 4,429,556 | 02/07/84 |
| Foshee | 4,437,695 | 03/20/84 |
| Gater et al. | 4,631,944 | 12/30/86 |
| Martin et al. | 4,648,639 | 03/10/87 |
| Best et al. | 4,655,059 | 04/07/87 |
| Huang et al. | 4,660,395 | 04/28/87 |
| Gater et al. | 4,672,829 | 06/16/87 |

No exhaustive search of the prior art has been done.

SUMMARY OF THE INVENTION

Accordingly, there has long been a need for an improved lock arrangement in which a comparatively sturdy declutching mechanism is provided that allows driving engagement with the outer handle for retracting the latch for the lock in the unlocked position and prevents retraction of the latch upon operation of the outer handle when the lock is in the locked position. Such structure must be sufficiently strong to withstand comparatively high forces.

In accordance with the principles of the present invention in a first preferred embodiment, there is provided a lock arrangement which has an inner handle which, in preferred embodiments of the present invention, is an inner lever which is adapted to rotate about a first axis. The first axis extends longitudinally through the lock arrangement. In this first preferred embodiment there is a push button concentrically mounted on the first axis within the inner lever. The push button moves both reciprocatingly along the first axis and rotates about the first axis. In a second preferred embodiment of the present invention the push button moves reciprocatingly along the first axis but does not rotate. In yet another preferred embodiment, there is no push button mounted on the inner lever. While such push button operations of lock arrangements are well known in the art, in the embodiments of the present invention, having a push button, the push button is attached to a dogging bar which extends along the interior of the lock arrangement towards the outer lever and the dogging bar may rotate and reciprocate with the push button or only reciprocate with the push button. In the first and second preferred embodiments, for the push button pressed in a direction towards the outer handle the lock arrangement is in the locked position. For the push button retracted in a direction away from the outer handle the lock arrangement is in the unlocked position. Detents are provided to restrain the push button and dogging bar in the locked position. The detents engage the walls of a catch and the catch is spring biased towards the engagement with the detents in the dogging bar.

The outer handle, which in preferred embodiments of the present invention is a lever, is connected to an outer lever spindle which rotates about the first axis for rotation of the outer handle about the first axis. The outer lever spindle is generally tubular in shape and has an inner section having a radially inwardly-directed tab portion having internal walls concentric with the first axis and the internal walls having a first predetermined geometric configuration.

Concentrically mounted within the tab portion of the outer lever spindle is a driver. The driver has a first end positioned towards the outer handle and a second end positioned towards the inner handle. In preferred embodiments of the present invention the driver is tubular in shape and has a first section on the outer surface thereof having the first predetermined geometric configuration in cross-section to match the cross-sectional configuration of the tab portion of the outer lever spindle. The first portion extends from the first end of the driver a preselected distance towards the second end of the driver.

The driver also has a second portion on the outer surface thereof and the second portion has a radial extent less than the first portion.

In preferred embodiments of the present invention the second portion of the outer surface of the driver has a second geometric configuration and cross-section which is different from the first portion. In preferred embodiments of the present invention the first portion of the outer surface of the driver may, for example be square and the second portion of the outer surface of the driver may, for example, be round. However, other geometrical configurations may be selected depending upon the application. In the above-described embodiment and in other embodiments with such other configurations, it is, of course, necessary that the second portion of the outer surface of the driver be configured so as to be free of driving engagement with the tab portion on the outer driver spindle. The second end of the driver has a flanged portion extending radially outwardly from the second portion. A push cup has a first end positioned against the flange portion of the driver and extends axially towards the inner handle and has a second end engaging the dogging bar.

The push cup, in preferred embodiments of the present invention is generally tubular and is concentrically mounted about the first axis for reciprocating movement therealong.

A generally tubular outer drive spindle is coaxially mounted around the outer surface of the push cup and the outer drive spindle has a first end having an inwardly directed tab portion which has an internal surface having the first pre-selected geometric cross-section as the tab portion of the outer lever spindle and the first portion of the outer surface of the driver. The tab portion of the outer drive spindle is axially adjacent the tab portion of the outer lever spindle and, for the lock in the unlocked position the first portion of the outer surface of the driver engages both the tab portion of the outer lever spindle and the outer driver spindle. Rotation of the outer handle causes the tab portion of the outer lever spindle to engage the first portion of the outer surface of the driver to rotate the driver about the first axis. In the unlocked condition of the lock, rotation of the driver causes the first portion of the outer surface of the driver to engage the tab portion of the outer drive spindle. A second end of the outer drive spindle has a flange portion for engaging the latch mechanism to retract the latch.

A resilient means is positioned between the flange at the second end of the driver and the tab portion of the outer drive spindle. The resilient means, which may be a spring, biases the lock in the unlocked position. Actuation of the push button from the unlocked position axially inwardly towards the outer handle causes the dogging bar to move the push cup in an axially direction toward the outer handle which, in turn, moves the driver against the resiliency of the spring and positions the second portion of the outer surface of the driver into alignment with the tab portion of the outer drive spindle. The second portion of the outer surface of the driver is, as noted above, free of engagement with the tab portion of the outer drive spindle in the locked position. For the lock in the locked position, rotation of the outer handle causes rotation of the driver without rotation of the outer drive spindle. In the unlocked position the driver is moved so that the first portion of the surface thereof engages both the tab portion of the outer lever spindle and the outer drive spindle to cause unlatching of the latch.

In the first preferred embodiment, the push button may move independently of the inner lever from the unlocked to the locked position. For the condition of the push button in the locked position, subsequent rotation of the push button rotates the detents on the dogging bar away from engagement with the walls of the catch. For the condition of the detents free of locking engagement with the catch, the dogging bar and push button move in a direction away from the outer lever. Rotation of the inner lever for the push button in either the locked or unlocked position causes retraction of the latch so that the door may be opened from the inside with the dogging bar still in the locked position and the detents engaging the walls of the catch, upon the door being closed it is still locked and cannot be opened from outside by only operation of the outer lever. In the second preferred embodiment of the present invention the push button and dogging bar move reciprocatingly along the first axis independently of the inner lever but are operatively connected to the inner lever for rotation therewith. In this second embodiment for the condition of the detents in the dogging bar engaging the walls of the catch, rotation of the inner lever rotates the dogging bar so that the detents are free of the walls of the catch. The dogging bar and button move in a direction away from the outer lever. The rotation of the inner lever also causes retraction of the latch so that the door may be opened from the inside. However, in this second preferred embodiment, since the dogging bar and button are in the unlocked condition, after the door is closed the door may be opened by rotation of the outer lever. To provide locking of the door, the push button must be actuated to return the dogging bar so that the detents again engage the walls of the catch to restrain the dogging bar in the locked position.

In both the first and second preferred embodiments, for the push button and dogging bar in the locked condition, the dogging bar has pushed the push cap against the driver so that the driver has moved axially towards the outer lever and the driver is free of driving engagement with the outer drive spindle. The door cannot be unlocked from the outside by only rotation of the outer lever in this condition.

In preferred embodiments of the present invention a conventional key-operated cylinder lock is mounted within the outer handle and the cylinder lock has a tail piece extending substantially along the first axis interior of the outer drive spindle and push cap. In such an embodiment a key spindle which is generally tubular in shape is rotatably mounted for rotation about the first axis and is positioned intermediate the drive spindle and push cap. The key spindle has radially extending tab portions extending within the push cap and the push cap has a split at its first end to have axially-extending prongs on its first end extending through the key spindle for engagement with the driver. Upon actuation of the key cylinder the tail piece is rotated and engages the tabs on the key spindle. The interior end of the key spindle has a flange engaging the latch for retraction of the latch upon rotation of the key spindle. It will be appreciated, however, that such key spindle may be omitted and, in such an embodiment, the driver and push cap may be of solid construction rather than tubular.

In yet another embodiment of the present invention the push cap, push button and dogging bar structure are omitted. In such an embodiment the rotation of the inner lever always causes the retraction of the latch so that the door may be opened. The tail piece of the key operated cylinder lock mounted in the outer lever engages a cam to rotate the cam as the key is turned. A cam follower bears against the cam race of the cam. The resilient means positioned between the flange on the driver and the tab portion of the outer drive spindle provide a spring bias of the driver and cam against the cam follower. In the locked condition, the driver and the cam are positioned towards the outer lever and the second portion of the outer surface of the driver is aligned with the tab portion of the outer drive spindle and rotation of the outer lever does not rotate the outer drive spindle and the door remains locked. The cam follower engages detents on the cam face. As the driver and cam are rotated by the tail piece of the key operated cylinder the cam moves down along the cam follower and the driver moves toward the inner lever. For the cam follower at the bottom of the cam face, the first portion of the outer surface of the driver is aligned with the tab portion of the outer drive spindle. In this position, rotation of the outer lever rotates the door lever spindle which rotates the driver and the driver rotates the outer drive spindle causing retraction of the latch. In another embodiment, similar to the cam and cam follower arrangement described above, the position of the cam and cam follower are reversed. The operation of such an embodiment is similar to that described above.

Another embodiment of the present invention has particular use in bathrooms where it is desired to allow locking from the inside but also unlocking from the outside even though the inside is in a locked condition. Such applications allow, for example, opening of the door from the outside when the person inside, such as a child, is unable to unlock the door. In such an embodiment, the key cylinder may be replaced by a slotted button, or a push turn button engaging the tail piece which may be similar to the key cylinder tail piece.

However, the tail piece may be moved to extend through the driver and into the push cap for engagement with the dogging bar. The reciprocating movement of the outer button and tail piece and the rotation of the outer button causes rotation of the dogging bar and unlocks the door.

BRIEF DESCRIPTION OF THE DRAWINGS

The above and other embodiments of the invention may be more fully understood from the following detailed description taken together with the accompanying drawing wherein similar reference characters refer to similar elements throughout and in which:

FIG. 7 is a perspective view of a driver according to the principles of the present invention;

FIGS. 8A through 8E illustrate various cross-sectional configurations of a portion of the driver useful in the practice of the present invention.

FIG. 11 is a perspective view of a tubular push cap useful in the practice of the present invention.

DESCRIPTION OF THE PREFERRED EMBODIMENTS

Figure 1:
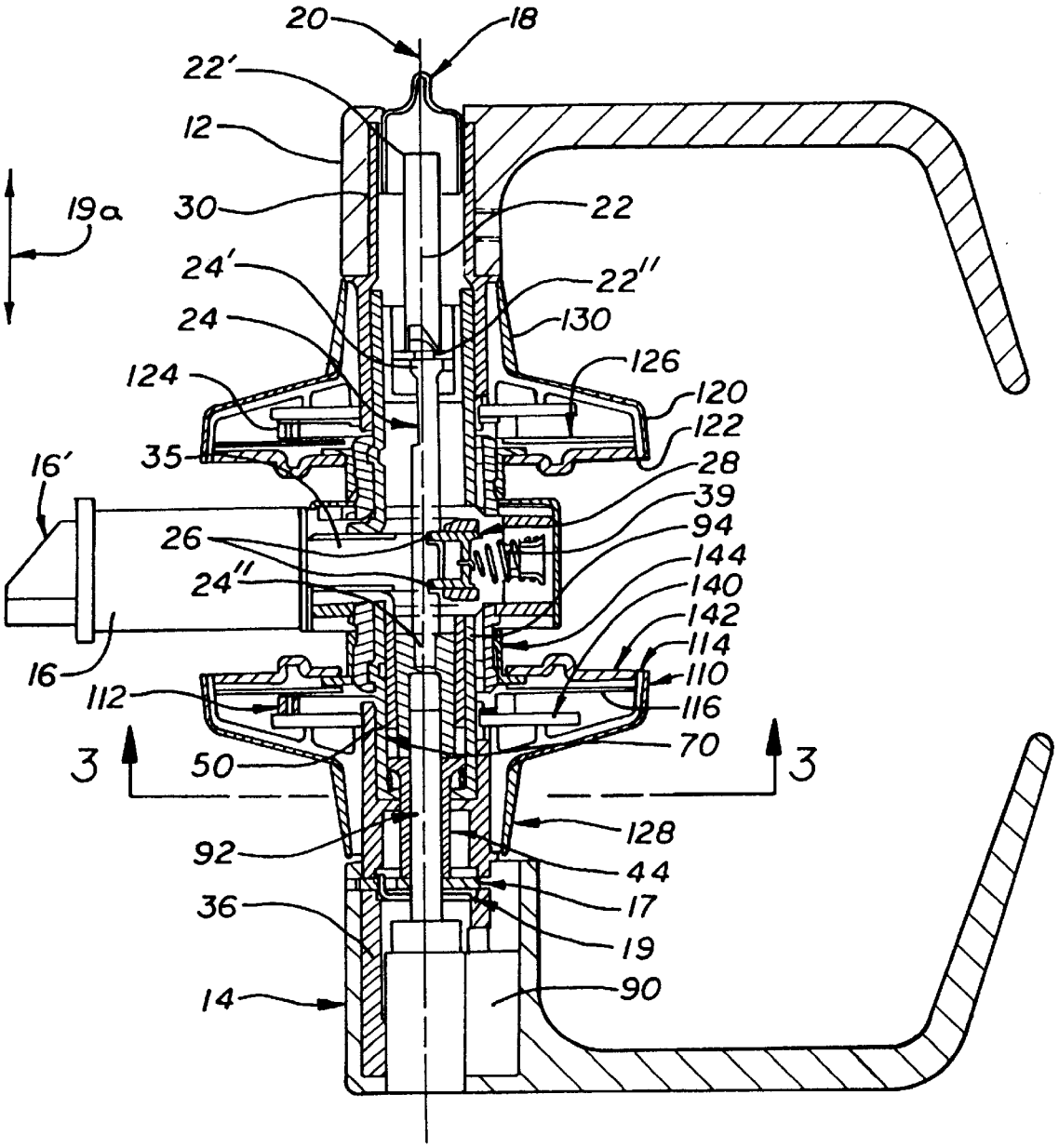
FIG. 1 is a cross-section view of the lock arrangement of the present invention in the locked condition.
Figure 2:
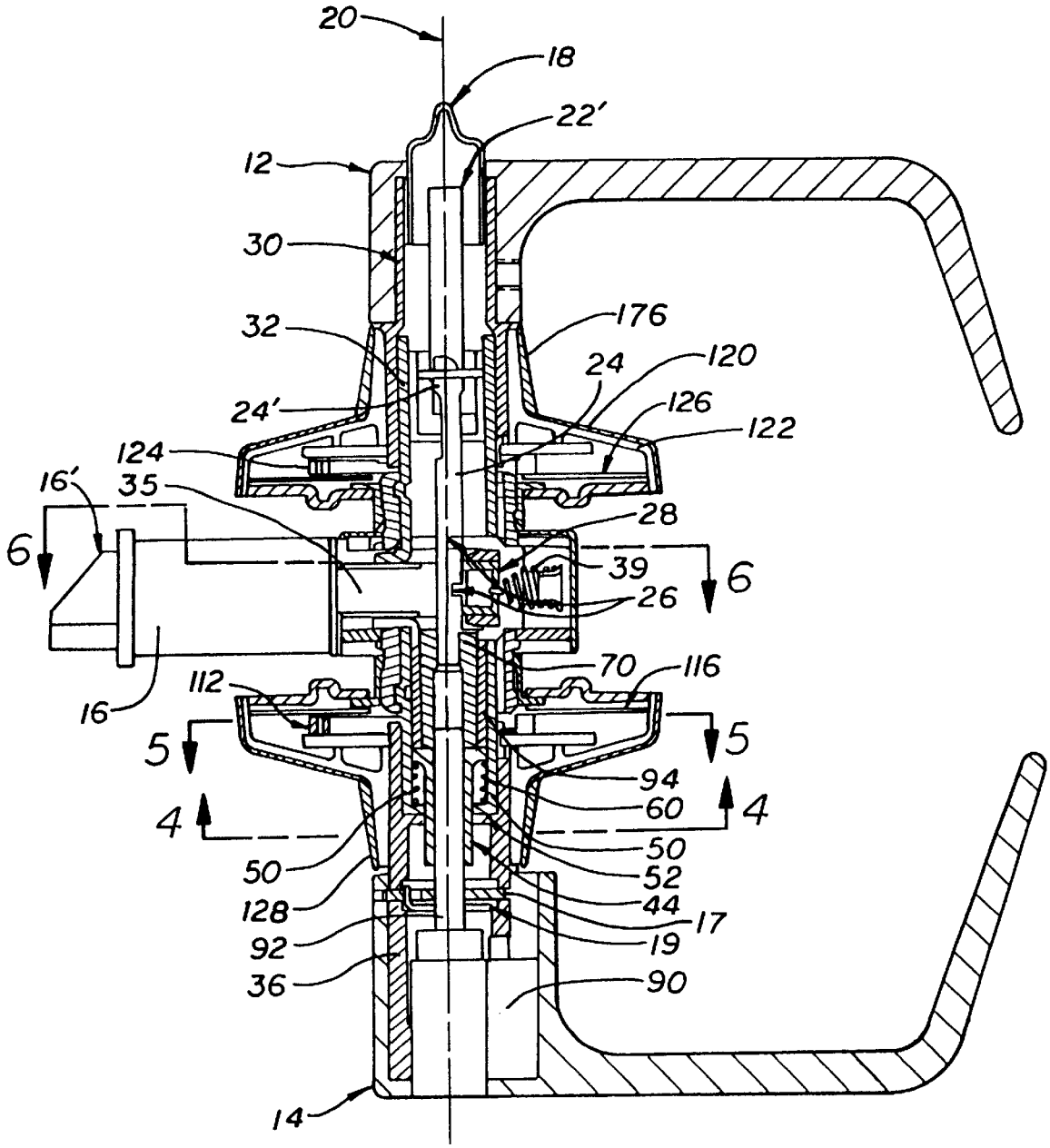
FIG. 2 is a cross-sectional view of the lock arrangement according to the principles of the present invention in the unlocked condition.
Figure 3:
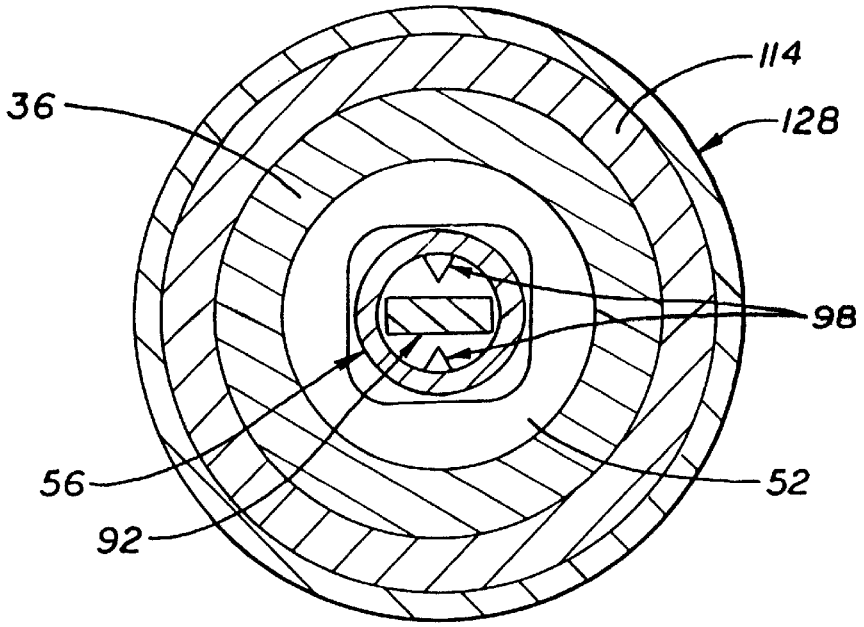
FIG. 3 is a sectional view along the line 3—3 of FIG. 1.
Figure 4:
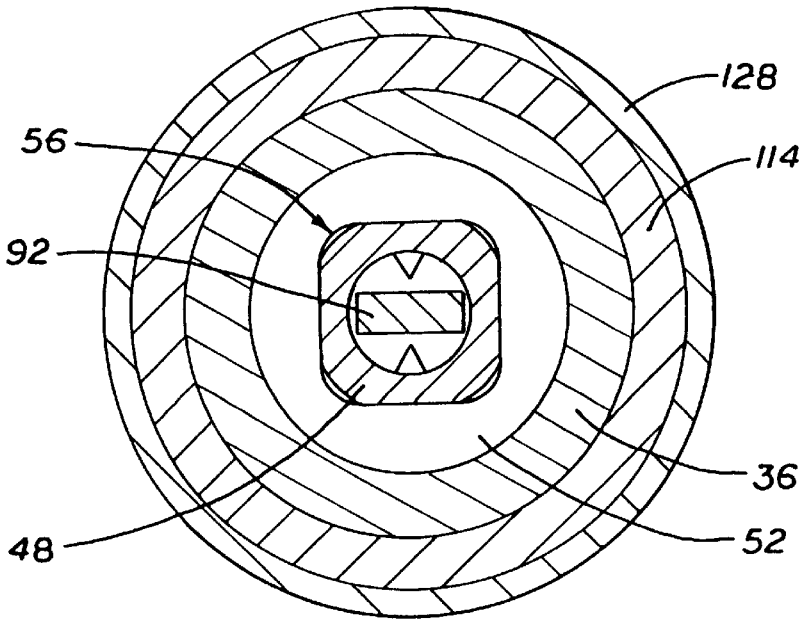
FIG. 4 is a sectional view along the line 3—3 of FIG. 2.
Figure 5:
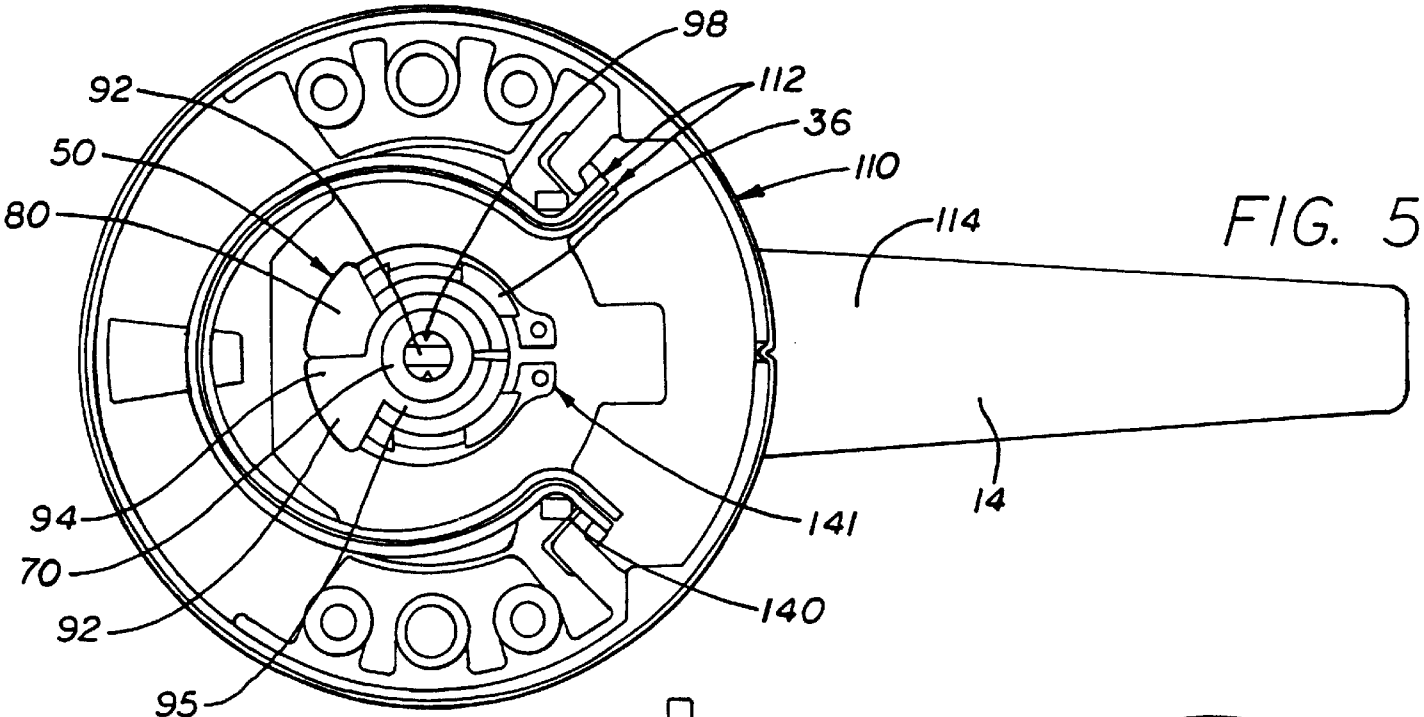
FIG. 5 is a sectional view along the line 3—3 of FIG. 2.
Figure 6:
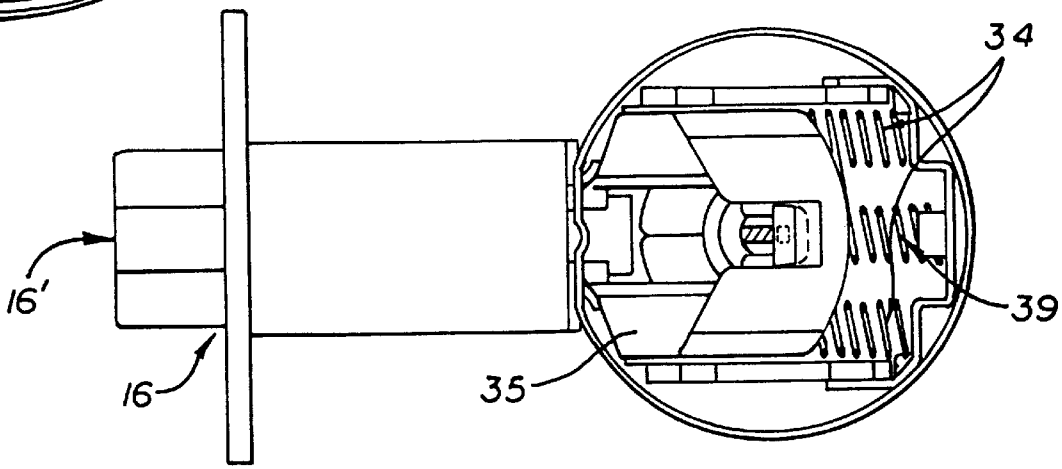
FIG. 6 is a sectional view along the line 3—3 of FIG. 2.

Referring now to the drawings and in particular FIGS. 1 through 6, there is illustrated a preferred embodiment of the present invention incorporating a push turn button on the inside. As shown in FIGS. 1 through 6 there is a lock arrangement generally designed 10 having an inner handle which in preferred embodiments of the present invention is an inner lever 12, an outer handle which in preferred embodiments of the present invention is an outer lever 14 and a retractable latch arrangement 16 having a latch portion 16'. The latch arrangement 16 may be of conventional design utilized in locks and the latch portion 16' is biased into the latching position thereof by latch springs (not shown). The retractor 35 is moved against the retractor springs 34 by the various spindles of the present invention, as described below, to cause retraction of the latch portion 16' which allows the door to be opened. A push/turn button 18 is mounted in the inner lever 12 along the axis 20 for reciprocating the rotational movement therewith. The push/turn button 18 moves reciprocatingly in the directions indicated by the arrow 19*a* between a locked position as indicated in FIG. 1 and an unlocked position as indicated in FIG. 2. In FIG. 1 the push/turn button 18 is shown in the inwardly directed position which is the locked position and in which the push/turn button 18 is moved towards the outer lever 14. Outer lever retainer 17 and spring 19 are provided as shown on FIGS. 1 and 2 for purposes known in the art.

A mounting means 22 is connected to the push/turn button 18 at its first end 22' and has a second end 22" connected to a dogging bar 24 at the first end 24' thereof. The dogging bar 24 has a second end 24". In preferred embodiments of the present invention. the dogging bar 24 is substantially aligned with and along the axis 20. Detents are provided in the dogging bar at 26 for retention of the push/turn button in the locked position by engagement with the catch 28. A spring 39 (FIG. 6) biases the catch 28 towards the dogging bar 24 and is moved into compression to move the catch 28 out of engagement with the detents 26 of the dogging bar 24 when the retractor 35 is moved to unlock and open the door. A spring, as described below in connection with FIG. 9, biases the push/turn button 18 into the unlocked position as illustrated in FIG. 2. The push/turn button 18, as noted above, also rotates about the axis 20 during the reciprocating movement thereof in the directions indicated by the arrow 20.

In the embodiment 10 the dogging bar 24 moves reciprocatingly and rotationally independently of the movement of the inner lever 12. Thus, to lock the door, the push/turn button 18 is moved inwardly towards the outer lever 14 and then rotated to engage the detents 26 with the catch 28, as shown in FIG. 1. To unlock the door from the inside, the push/turn button 18 is rotated to free the detents 26 from the catch 28 and the dogging bar 24 and push/turn button 18 are moved away from the direction of the outer lever 14 to the unlocked position shown on FIG. 2. For the latch in the latched position as shown in FIGS. 1 and 2 the door is in the locked condition. That is, the door cannot be opened unless the latch is retracted. For the latch retracted, the door is in the unlocked condition and may be opened. The various embodiments described herein allow selective operation of the latch to retract the latch and allow the door to be opened.

In those embodiments of the present invention in which the inner push button is just a "push" button and not a push/turn button as in the embodiment 10, the push button moves reciprocatingly along the first axis 20 until the detents 26 are aligned with the catch 28. The spring 39 biases the catch 28 to engagement with the detents 26. To provide unlocking of such an embodiment the "push" button is operatively connected to the inner lever 12 for rotation therewith. Rotating the inner lever 12 rotates the "push" button and dogging bar 24 to force the detents 26 from the catch 28. The dogging bar 24 and "push" button then move in a direction away from the outer handle to the position shown in FIG. 2. To lock the door from the unlocked position shown in FIG. 2, the "push" button is moved toward the outer lever 18 until the detents 26 are aligned with the walls of the catch 28. The inner lever is then rotated which rotates the "push" button and dogging bar, the bias of spring 39 forces the walls of catch 28 into engagement with the detents 24 thus locking the door.

The inner lever 12 is connected to an inner lever spindle 30 for rotation with the inner lever 12 and the inner lever spindle engages an inner drive spindle 32 for rotational movement thereof about the axis 20. The inner drive spindle 32 is operatively connected to the latch arrangement 16 for engagement with the retractor 35 for retraction of the latch portion 16' against the bias of the retractor springs 34 upon rotation of the inner lever 12 about the axis 20. As noted above, movement of the retractor 35 also moves the spring 39 to move the catch 28 away from engagement with the dogging bar 24 detents 26. This releases the dogging bar 24 from the catch 28.

The outer lever 14 is connected to an outer lever spindle 36 which rotates with the outer lever about the axis 20. The outer lever spindle 36 is generally tubular and is concentrically mounted on the first axis 20.

Figure 9:
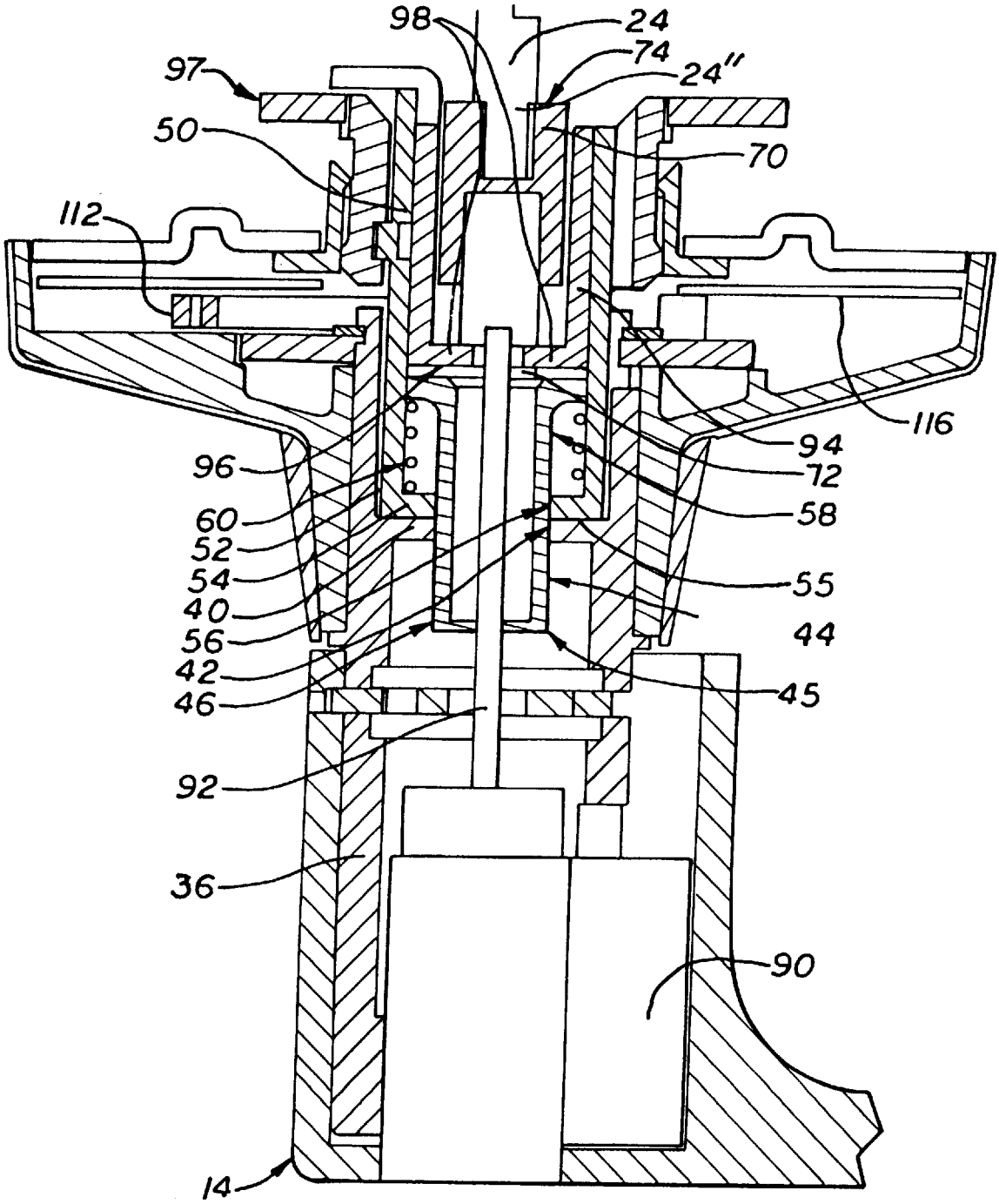
FIGS. 9 and 10 are enlarged cross-sectional views showing the key spindle, push cap, and tail piece as mounted in the lock.
Figure 10:
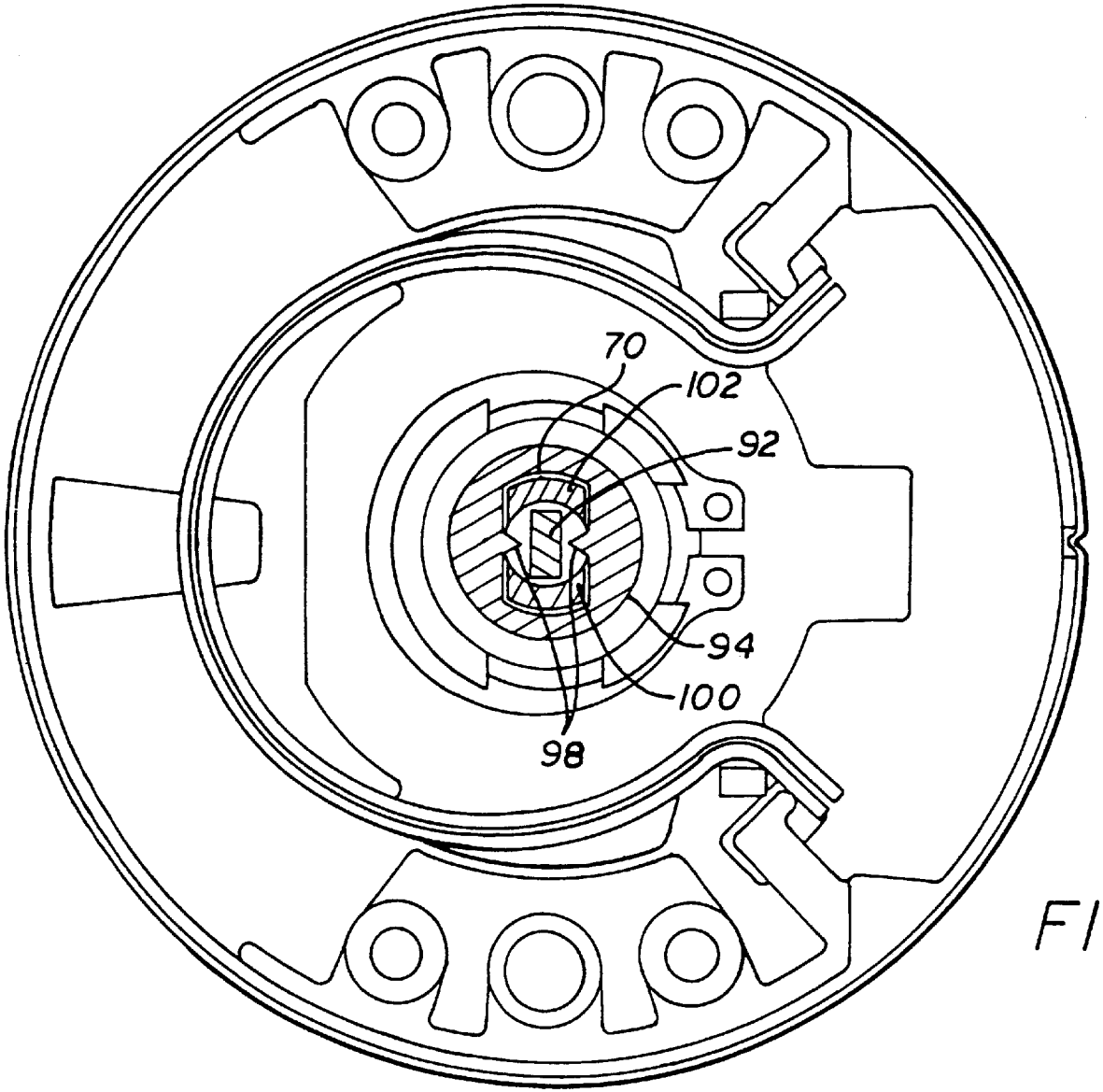

As shown move clearly on FIG. 9, the outer lever spindle 36 has an inner tab portion generally designated 40 which extends radially inwardly towards the axis 20. The inner surface 42 of the tab portion 40 has a first preselected geometrical configuration, for purposes as hereinafter disclosed. As shown, for example in FIGS. 3 and 4, in the embodiment 10 the first preselected geometrical configuration is a square.

A driver generally designed 44 is coaxially positioned on the center line 20 and has a first end 45, an outer surface generally designated 46 having a first section generally designed 48 which has the same first preselected geometrical configuration as the inner surface 42 of the tab 40 of the outer lever spindle 36. The driver 44, in the embodiment 10, is generally tubular and is illustrated in greater detail in FIG. 7.

Rotation of the outer lever 14 rotates the outer lever spindle which, through engagement of the inner surface 42 of tab portion 40 with the first section 48 of the outer surface 46 of the driver 44 rotates the driver 44 about the axis 20.

As illustrated in FIG. 9, which shows embodiment 10 in the unlocked position, there is also provided a generally tubular outer drive spindle generally designated 50 which has a first end 52 having a radially inwardly-directed tab portion 54 having an inner surface 56. The inner surface 56 of the tab portion 54 of the outer drive spindle 50 has the above-stated first preselected geometrical configuration. The tab portion 54 is adjacent the tab portion 40 of the outer lever spindle 36 and the spacing therebetween is preferably small, as indicated at 55 being just sufficient to allow independent rotation of the outer lever spindle 36 and outer drive spindle 50.

The driver 44 has a second section 58 of the outer surface 46 and the second section 58 has a second preselected geometrical configuration. The radial extent from the axis 20 of the second section 58 is less than the radial extent of the first section 48 of the driver 44. The difference in radial extent between the first section 48 and the second section 58 is such that for the condition of the second section 58 aligned with the tab 54 of the outer lever driver 50 the tab 54 is free of engagement with the second portion 58. As a result thereof, rotation of the driver 44 about the axis 20 as caused by rotation of the outer lever 14 and outer lever spindle 36 and outer drive spindle 50 is not rotated. For the lock arrangement 10 in the locked position, the second section 58 of driver 44 is aligned with tab 54 outer lever driver 50 and first section 48 of driver 44 is aligned with tab 40 of outer lever spindle 36. In the unlocked position of the lock arrangement 10, the first section 48 of driver 44 is aligned with both tab portion 54 of outer driver spindle 50 and tab portion 40 of outer lever spindle 36. In the unlocked position of lock arrangement 10, rotation of the outer lever 14 rotates the outer lever spindle 36 which rotates the driver 44 which, in turn, rotates the outer drive spindle 50.

A spring 60 is positioned between a flange 62 at the second end 64 of the driver 44 and the spring 60 also engages the tab 54 of the outer drive spindle 50 for resiliently biasing the driver 44 into the unlocked position as depicted in FIG. 9.

A push cap 70 which is illustrated in greater detail on FIG. 11 is coaxially mounted on the axis 20 and interior of the outer drive spindle 50. The push cap has a first end generally designated 72 which engages the flange 62 at the second end 64 of the driver 44. The push cap 70 has a second end 74 against which the dogging bar 24 abuts. Movement of the dogging bar 24 towards the outer lever 14 in the direction indicated by the arrow 76 moves the push cap 70 and driver 44 against the bias of the spring 60.

Movement of the push button 18 (FIGS. 2 and 3) in the direction indicated by the arrow 76 for the condition of the detents 26 free of locking engagement with the catch 28 moves the dogging bar 24 in the direction of the arrow 76. The push cap 70, as moved by the dogging bar 24, pushes the driver 44 towards the outer handle 14 until the second section 58 of the outer surface 46 of the driver 44 is radially aligned with the inner surface 56 of the tab 54 of the outer drive spindle 50. Such movement and position of the driver 44 corresponds to the locked position and the detents 26 engage the walls of the catch 28. As noted above in the locked position the second section 58 does not engage the inner surface 56 of the tab portion 54 of the outer drive spindle 50. For such condition rotation of the outer lever 14 causes rotation of both the outer lever spindle 36 and the driver 44 about the axis 20 but without rotation of the outer drive spindle 50. As a result, for the lock arrangement of embodiment 10 in the locked condition as provided by operation of the push button 18, rotation of the outer handle 14 does not retract the latch 16'.

The outer drive spindle 50 has an ear 80 which engages the retractor 35 of the latch arrangement 16 to move the retractor 35 against the retractor springs 34 to retract the latch 16'. In the locked position the outer drive spindle 50 is not rotated with rotation of the outer lever 14 and there is no retraction of the latch 16'.

In some of the preferred embodiments of the present invention key cylinder 90, one of the types known in the art such as a conventional or a removable cylinder, is positioned within the outer lever 14 and is connected to a tail piece generally designated 92 which, in the embodiment 10, is aligned along the axis 20.

A generally tubular key spindle 94 is positioned intermediate the outer driver spindle 50 and the push cap 70. The key spindle 94 has a first end 96 provided with drive tabs 98. As shown most clearly in FIGS. 5 and 9 rotation of the tail piece 92 causes it to engage the inwardly-directed tabs 98 to rotate the key spindle 94. An inner end 95 of the key spindle 94 has a flange 97 which engages the retractor 35 of the latch arrangement 16' to cause a retraction of the latch 16 against the resiliency of the retractor springs 34. In such an embodiment the driver 44 is tubular to allow the tail piece 92 to extend therethrough and the push cap 70 has engaging portions 100 and 102 which extend through the key spindle 94 for engagement with the push cap 44.

As illustrated in FIG. 7 the first section 48 of the outer surface 46 of driver 44 has the first preselected geometrical configuration and cross-section which, in embodiment 10, is generally square having slight chamfers as indicated at 47. This cross-sectional configuration, as noted above, corresponds to the cross-sectional configuration of the inner surface 42 of the tab 40 of outer lever spindle 36 and the inner surface 56 of the tab 54 of the outer driver spindle 50. The second section 58 of the outer surface 46 of the driver 44 has the second preselected geometrical configuration and cross-section which in embodiment 10, is round. However, other geometrical configurations for the first section 48 and second section 58 of driver 44 may be selected. It is necessary, however, that in the locked position the second section 58 be free of rotational drive engagement with the surface 56 of tab 54 of outer drive spindle 50.

FIG. 8A illustrates various other geometrical configurations for the cross-section of the first section 48 of the outer surface 46 of the driver 44. In each embodiment utilizing such cross-sections the inner surface 42 of the tab 40 on the outer lever spindle 36 and the inner surface 56 of the tab 54 on the outer drive spindle 50 have surfaces for engagement with the first section 48 of the driver 44. In preferred embodiments of the present invention, the interior surfaces 42 and 56 of tabs 40 and 54, respectively, have the same geometrical configuration as the geometrical configure ration of the first section 48 of the driver 44. However, the principles of the present invention may be accomplished by having a wall section of the inner surfaces 42 and 56 of the tabs 40 and 54, respectively, having a driving engagement with the first section 48 of driver 44. Thus, in FIG. 8A the geometrical cross-sectional configuration is generally triangular for a driver generally designated 44A. In FIG. 8B the cross-sectional configuration of the driver 44B is generally rectangular. For the driver 44C of FIG. 8C the cross-sectional configuration is generally hexagonal. For the driver 44D of FIG. 8D the cross-sectional configuration has a round portion generally designated 44D' and a planar portion generally designated 44D" . In FIG. 8E a driver 44E has a generally sinusoidal cross-sectional configuration having the lobes 44E', but no planar section. In each of the drivers 44A through 44E it will be appreciated that the second portion 58 (not shown in FIGS. 8A through 8E) of the outer surface 46 has a geometrical configuration such that the second portion 58 does not engage the inner surface 56 of the tab 54 on the outer driver spindle 50 for the condition of the driver in the locked condition. Thus, the second section 58 of outer surface 46 or driver 44 may be the same geometrical configuration as the first section 48 of outer surface 46 of a different geometrical configuration as long as the radial extent thereof prevents driving engagement with the inner surface 56 of tab 54 of outer drive spindle 50 in the locked condition.

Referring to FIGS. 1 and 2, the embodiment 10 also has an outer rose cover 110 which contains an outer lever return spring means 112 within a rose insert 114 inside of the rose cover 110. The outer lever return spring 112 returns the outer lever 14 after rotation to its preferred position which, generally, is horizontal. An outer lever return spring retainer plate generally designed 116 is positioned within the outer rose insert 114 to retain the outer lever return spring 112 in position.

There is also an inner rose cover 120 surrounding an inner rose insert 122 and positioned within the inner rose insert 122 is an inner lever return spring means 124 retained in position by an inner lever return spring retainer plate 126. Similarly, an outer collar generally designated 128 and an inner collar generally designated 130 are provided for proper retention of the rose covers in position.

The lock arrangement of embodiment 10 as shown in FIG. 1, also includes an outer lever stop plate 140, outer lever mounting plate 142, and outer lever mounting plate nut 144 for purposes well known in the art. Similar structure for the inner lever 12 are also provided as illustrated in FIG. 1. Similarly, snap ring 141 is provided to retain axial alignment of the components as required.

Figures 12, 13:
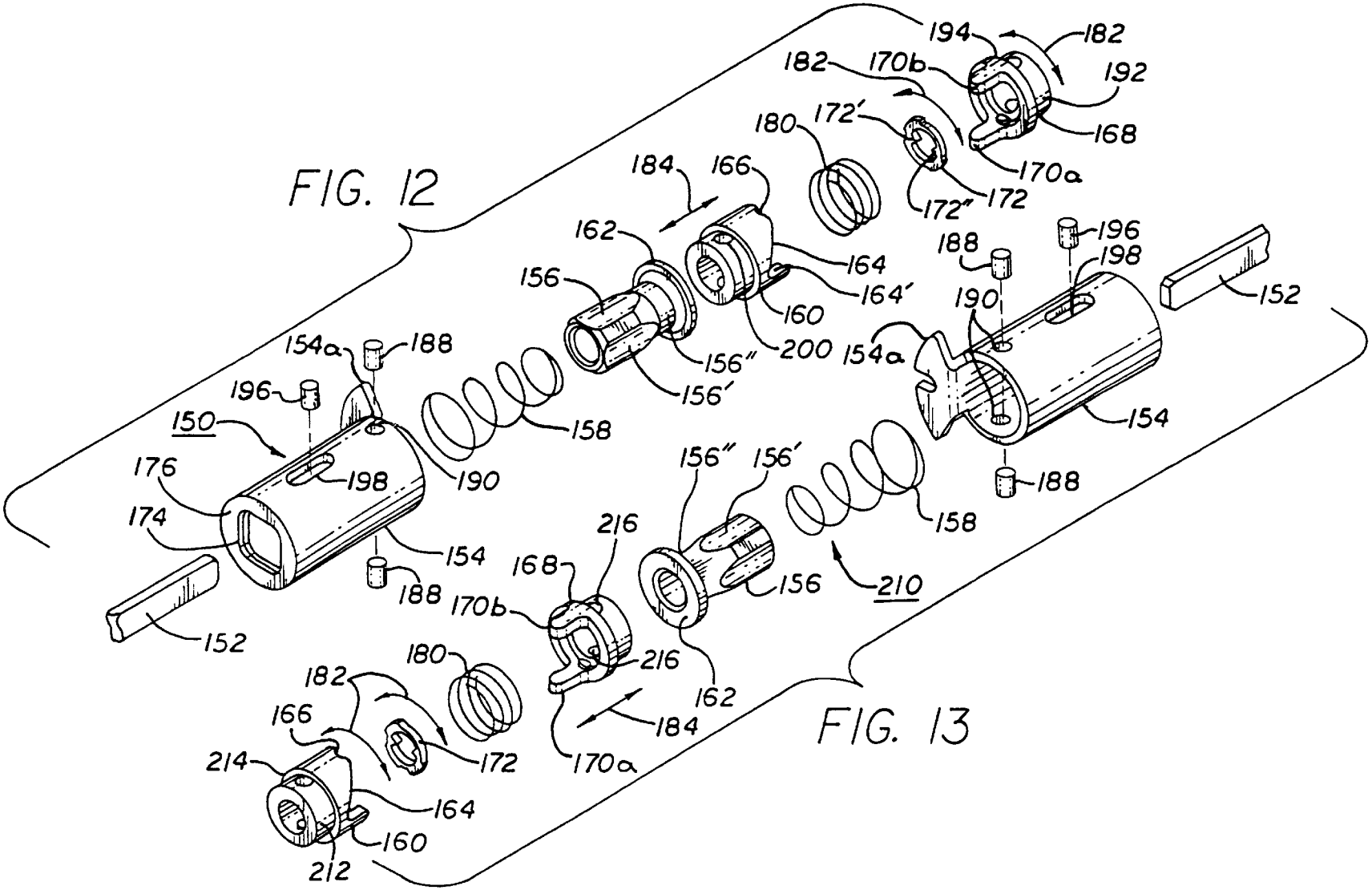
FIG. 12 is an exploded view of another embodiment of the present invention.
FIG. 13 is an exploded view of another embodiment of the present invention.

Referring now to FIG. 12, there is shown an embodiment generally designated 150 of the present invention in which there is not provided any button on the inside of the inner lever. As noted above, in such embodiments the push cap 70 is omitted as well as the push button and dogging bar. The rotation of the inner lever always causes operation of the latch so that the door may be opened. Locking and unlocking is accomplished from the outside. As shown in FIG. 12, a tail piece 152 which may be similar to tail piece 92 of the embodiment 10 extends axially through a generally tubular outer drive spindle 154 which may be similar to outer drive spindle 50. A driver 156 similar to driver 44 and spring 158 similar to spring 60 are positioned in outer drive spindle 154 for rotational and reciprocating motion. A cam 160 abuts against the flange 162 of driver 156 and has a cam face 164 and detents 166.

Resilient means 180 is positioned between cam 160 and a cam follower 168 mounted in the lock mechanism of embodiment 150. The cam follower 168 rotates in the directions indicated by the arrow 182 The cam follower 168 has prongs 170*a* and 170*b* which engage the detent 166 in cam 160 for the lock in the locked condition. The cam 160 moves in reciprocating directions as indicated by the arrow 184. The prongs 170*a* and 170*b* of cam follower 168 engage the cam face 164 during the transition of the embodiment 150 from the locked condition to the condition allowing the door to be opened. The resilient means 180 biases the cam 160 away from the cam follower 160. A plate 172 is intermediate the cam 160 and cam follower 168 and operatively engages the cam follower 168 to rotate the cam follower 168. The plate 172 has tabs 172' and 172" which engage the tail piece 152. When the tail piece 152 is rotated, for example clockwise to rotate the cam follower 168 through engagement with the plate 172, the prongs 170*a* and 170*b* move out of the detents 166 and along the cam face 164 as the spring 158 biases the driver 156 and cam 160 toward the cam follower 168. This axial movement of the driver provides the alignment of the first section 156' of driver 156 with the inner surface 174 of tab 176 of the outer driver spindle 154. In such an alignment, operation occurs as described above. That is, rotation of an outer lever rotates the outer lever spindle which rotates the driver 156 to rotate the outer drive spindle 154 and the ear 154*a* engages a retractor to retract a latch. The outer lever and outer lever spindle are omitted for clarity in FIG. 12. For the embodiment 150 in the unlocked position, that is, for example, when the prongs 170*a* and 170*b* are at the bottom 164' of cam face 164, rotation of the tail piece 152 in the opposite direction, that is, counterclockwise, forces the cam follower 168 to rotate and forces the prongs 170*a* and 170*b* of cam follower 168 up the cam face 164 to the detents 166. Such motion forces the driver 156 outward until the second section 156" of the outer surface of driver 156 is aligned with inner surface 174 of tab 176 of outer drive spindle 154. In such condition, the driver 156 does not rotate the outer lever drive 154 upon rotation of the outer lever spindle and the embodiment 150 is in the locked condition.

Pins 188 are press fit into apertures 190 in outer drive spindle 154 and engage the outer end surface 192 of cam follower 168 and bear against rim 194 to prevent axial movement of the cam follower in a direction away from the outer drive spindle 154. In the embodiment 150 the biasing force of the spring 158 forces the cam 160 into engagement with the prongs 170*a* and 170*b* of cam follower 168. The biasing force of the spring 150 biases the prongs 170*a* and 170*b* into detents 166 thereby providing the embodiment 150 in the locked condition as the normal condition. Rotation of tail piece 152 allows the opening of the door to which the embodiment 150 is coupled. Pin 196 is positioned in slot 198 in drive spindle 154 and press fit into aperture 200 in cam 160. Slot 198 allows cam 160 to move, relative to drive spindle 154, in the directions indicated by the arrow 184. Such motion allows positioning of the driver 156 between the locked and the unlocked positions.

FIG. 13 shows another embodiment of the present invention generally designated 210. The embodiment 210 is generally similar to the embodiment 150 of FIG. 12 except that the cam is mounted for rotational movement and no reciprocating movement, and the cam follower is mounted for reciprocating movement but not rotational movement. As shown on FIG. 13, a tail piece 152 extends axially through outer drive spindle 154. A driver 156 and spring 158 are positioned in outer drive spindle 154 for reciprocating and rotational movement. However, in embodiment 210, the cam follower 168 abuts against the flange 162 of driver 156 and has prongs 170*a* and 170*b*. The cam follower 168 moves in directions indicated by the arrow 184. A cam 160 is mounted in the lock mechanism for rotational movement in the directions indicated by the arrow 182. The prongs 170*a* and 170*b* of cam follower 168 engage the cam face 164 and detents 166 of cam 160. Pins 188 are press fit in apertures 190 in outer drive spindle 154 and engage the outer end surface 212 of cam 160 and bear against rim 214 to prevent axial movement of the cam 160 in a direction away from the outer drive spindle 154. Spring 180 provides a biasing of the cam follower away from the cam 160 to provide the prongs 170*a* and 170*b* in the detents 166 of cam 160 so that the normal position of the embodiment 210 is the locked position. To unlock the embodiment 210, the tail piece 152 is rotated and engages the plate 172 which operatively engages the cam 160 to rotate the cam 160 in the directions indicated by the arrow 182. The pin 196 is positioned in slot 198 of outer drive spindle and is press fit into one of the apertures 216 of cam follower 168. The slot 198 allows the reciprocating movement of the cam follower 168 in the direction of the arrow 184. Such reciprocating motion allows positioning of the first section 156' in drive engagement with outer drive spindle 154 as above described. Similarly, with the prongs 170*a* and 170*b* of cam follower 168 in detents 166 of cam 160, the locked position, the second section 156" is positioned relative to the outer drive spindle 154 so that rotation of the driver 156 does not rotate the outer drive spindle 154.

Thus, the embodiment 210 of FIG. 13 operates in a manner quite similar to the embodiment 150 of FIG. 12 except the positions of the cam 160 and cam follower 168 are reversed.

In other embodiments of the present invention, the cam and cam follower structure, as shown in embodiment 150 and/or 210 above, may be provided on both the inside and outside of the lock and the tail piece in any of the cam and cam follower arrangements, on the inside and/or the outside of the lock, may be rotated by a key and key cylinder arrangement as above-described or by a turn button which rotates the tail piece. Further, in other embodiments of the present invention, only one cam and cam follower structure may be utilized, for example, on the inside, with a blank, non-removable plate on the outside. Other embodiments of the present invention utilizing a cam and cam follower may incorporate various combinations of key and key cylinders, turn buttons, lever operation of latch retraction and similar structure as may be desired for particular applications.

In another embodiment of the present invention, useful for example in bathrooms, a push button may be on the inside to allow locking of the lock. Such an arrangement may be similar to the embodiment 10 described above except that the key cylinder is omitted on the outside and a slotted button or a turn button is connected to the tail piece such as tail piece 92 of, for example, FIG. 1 to allow rotation of the tail piece 92 thereby retracting the latch to allow the door to be opened.

This concludes the description of the preferred embodiments of the present invention. Those skilled in the art may find many variations and adaptations thereof and the appended claims are intended to cover all such variations and adaptations falling within the true scope and spirit of this invention.

What is claimed:

1. A driver in a lock arrangement of the type having a rotatable outer handle, an outer lever spindle connected to the outer handle for rotation therewith, a latch, an outer drive spindle for selectively retracting the latch, the outer drive spindle selectively rotated with the outer lever and outer lever spindle, the driver comprising, in combination:

a body member having a first axis and having a first end, a second end, and an external surface extending between said first end and said second end and having a locked position for the lock arrangement in a locked condition and an unlocked position for the lock arrangement in an unlocked condition;

said external surface having:

a first section having a first preselected geometrical configuration in regions adjacent said first end and said first section extending toward said second end, and said first section operatively engaging the outer lever spindle and rotated by the outer lever spindle and operatively engaging the outer drive spindle to engage and retract the latch for the lock in the unlocked condition;

a second section intermediate said first section and said second end and having a second geometrical configuration and said second section free of operative driving engagement with the outer drive spindle for the lock in a locked condition; and said body member of said driver axially movable along said first axis between said locked and unlocked positions;

means including a cam and a cam follower for selectively moving said driver axially in reciprocating motion between said locked and unlocked condition.

2. The arrangement defined in claim 1 and further comprising reciprocating and rotating means for moving said driver.

3. A clutch arrangement for a door lock of the type having a retractable latch for movement between a latched, locked position and an unlatched, unlocked position, comprising, in combination:

a handle;

a tubular lever spindle coupled to said handle and having an outer surface and an inner surface defining a drive spindle accepting aperture therethrough, and adapted to rotate with said handle about a first axis, and said tubular lever spindle having a tab portion extending radially inwardly, and said tab portion having walls defining an aperture therethrough and said aperture having a first preselected geometrical configuration;

a generally tubular drive spindle concentrically mounted on said first axis with said lever spindle and inside said inner surface of said lever spindle, and said drive spindle having an outer surface, an inner surface and adapted to rotate about said first axis extending therethrough, and having a first end and a second end, and an ear on said second end extending radially outwardly from said outer surface, and having a tab portion extending radially inwardly from said outer surface and said tab portion having walls defining an axially aligned aperture therethrough and said aperture having said first preselected geometrical configuration, and said tab portion of said drive spindle in close proximity to said tab portion of said lever spindle;

a driver concentrically mounted on said first axis in said drive spindle for axial reciprocating movement therealong and rotating movement thereabout, said driver having an outer surface, a first end and a second end, said outer surface having a first section extending from said first end toward said second end and having a second section extending from said first section to said second end, said first section having said first preselected geometrical configuration for rotationally driving engagement with said aperture in said tab portion of said drive spindle and for rotationally driven engagement with said aperture in said tab portion of said lever spindle whereby rotation of said handle rotates said lever spindle to rotate said driver to rotate said drive spindle for said driver in a first position, said second section having a second preselected geometrical configuration and said first section of said driver in said aperture of said tab portion of said lever spindle and said second section of said driver in said aperture of said drive spindle for said driver in a second position and said driver free of rotational driving engagement with said drive spindle in said second position;

and axial motion producing means for moving said driver axially between said first position and said second position, and said first position corresponds to the unlocked position and the second position corresponds to the locked position.

4. The arrangement defined in claim 3 and further comprising:

a latch retraction means;

said ear on said drive spindle operatively engaging said latch retraction means for rotation of said drive spindle to move said latch from said locked to said unlocked position.

5. The arrangement defined in claim 4 and further comprising:

said driver having a radially extending flange on said second end thereof.

6. The arrangement defined in claim 5 and further comprising:

first spring means between said flange on said driver and said tab on said drive spindle.

7. The arrangement defined in claim 6 wherein:

said driver has an axial aperture extending therethrough from said first end to said second end.

8. The arrangement defined in claim 3 wherein:

said axial motion producing means further comprises a cam and a cam follower.

9. The arrangement defined in claim 8 wherein:

one of said cam and said cam follower is axially movable and the other of said cam and said cam follower is rotatably movable.

10. The arrangement defined in claim 9 wherein:

said cam is axially movable and free of rotational movement; and said cam follower is rotatably movable and free of axial movement.

11. The arrangement defined in claim 9 wherein:

said cam is rotatably movable and free of axial movement;

said cam follower is axially movable and free of rotational movement.

12. The arrangement defined in claim 9 and further comprising:

second spring means intermediate said cam and said cam follower.

13. The arrangement defined in claim 12 and further comprising:

plate means selectively engaging said rotationally movable one of said cam and said cam follower for operative engagement therewith to provide rotation thereof.

14. The arrangement defined in claim 13 and further comprising:

tail piece means for driving engagment with said plate to rotate said plate.

15. The arrangement defined in claim 14 wherein:

said cam has first walls defining cam face and second walls defining a cam detent means;

said cam follower has prongs for engaging said cam face and said cam detents; and said driver is in said second position for the condition of said prongs in said cam detents and said driver moves from said second position to said first position for movement of said prongs from said detent along said cam face.

16. The arrangement defined in claim 3 wherein:

said axial motion producing means further comprises a dogging bar;

a push button for axially moving said dogging bar;

push cap means operatively engaging said dogging bar and said driver for providing said axial movement of said driver.

* * * * *